United States Patent [19]

Davis et al.

[11] 3,952,660

[45] Apr. 27, 1976

[54] FUZE SAFING AND ARMING DEVICE UTILIZING PROPELLANT IONIZATION

[75] Inventors: Harry J. Davis, Wheaton; Philip F. Ingersol, Silver Spring, both of Md.

[73] Assignee: The United states of America as represented by the Secretary of the Army, Washington, D.C.

[22] Filed: July 17, 1974

[21] Appl. No.: 489,306

[52] U.S. Cl. ..... 102/70.2 R; 102/70.2 G; 102/70.2 GA

[51] Int. Cl.[2] ..... F42C 11/00; F42C 15/40

[58] Field of Search ..... 102/70.2 R, 70.2 GA, 102/70.2 G

[56] References Cited

UNITED STATES PATENTS

| | | | |
|---|---|---|---|
| 1,917,813 | 7/1933 | Ruhlemann | 102/70.2 G |
| 2,505,042 | 4/1950 | Gourdon | 102/70.2 G |
| 3,324,317 | 6/1967 | Hazelet | 102/70.2 GA |
| 3,417,700 | 12/1968 | Furlani | 102/70.2 R |
| 3,669,024 | 6/1972 | Davies et al. | 102/70.2 R |

FOREIGN PATENTS OR APPLICATIONS

| | | | |
|---|---|---|---|
| 923,523 | 4/1963 | United Kingdom | 102/70.2 R |

*Primary Examiner*—Charles T. Jordan

*Attorney, Agent, or Firm*—Nathan Edelberg; Robert P. Gibson; Saul Elbaum

[57] ABSTRACT

This invention makes use of the gas that escapes past a shell as it emerges from a gun barrel to provide a safety and arming device. This gas is electrically active and has the properties of a plasma. Electrical charge from this gas accumulates on the surface of the projectile as it exits from the barrel. This accumulation takes place at the muzzle of the gun tube since the projectile is effectively grounded as it travels up the tube. The invention utilizes a specifically adapted capacitor to accumulate this charge and arm the fuze. Arming is provided by detecting a particular threshold of the charge on the capacitor and utilizing a standard "AND", "OR", or "NOR" gate to make the decision whether or not to initiate a standard mechanical arming mechanism.

10 Claims, 4 Drawing Figures

FUZE SAFING AND ARMING DEVICE UTILIZING PROPELLANT IONIZATION

RIGHTS OF THE GOVERNMENT

The invention described herein may be manufactured, used, or licensed for or by the United States Government for governmental purposes without the payment to the inventor of any royalty thereon.

BACKGROUND OF THE INVENTION

1. Field of the Invention

This invention relates specifically to safety and arming devices for ordnance fuzes for use on projectiles. Specifically, the invention is related to an electronic safety device for use in combination with either an electically activated mechancial arming device or electrically activated electrical arming devices. The invention is specifically related to that class of devices which utilizes the ionized gases from the propellant of the projectile in the muzzle of the firing tube as an environmental signature.

2. Description of the Prior Art

Existing mechanical safety and arming devices are limited in the number of environmental signatures usable as sources of information. The requirements now being established for modern ordnance fuzing demand additional safety and new environmental signatures.

In ordnance work, missiles and projectiles frequently employ electrical energy in their detonator trains. Conventionally, electrical energy is supplied by a battery or the like, and separate devices are employed for applying energy from the battery to the detonator train at the proper time. Means are provided to keep the missile or projectile in a safe, unarmed condition until it is desired that the missile or projectile be armed. Numerous efforts have been made to improve the simplicity and reliability of arming and detonator systems for projectiles and missiles. One result of such efforts is exemplified in the system disclosed in U.S. Pat. No. 3,098,163 to Robert W. Blis. Another related invention is exemplified in U.S. Pat. No. 3,324,317 to Gerald L. Hazelet.

Hazelet includes a supported and insulated piece of electric crystal which is subject to loading by an inertial mass in response to acceleration of the assembly employing the mass and crystal. The mass and crystal are housed together with a support in such a manner that discharge of a portion of the voltage generated in the crystal is accomplished by ionization of a gas therein; the constants being selected to provide discharge in response to a predetermined degree of acceleration. The arrangement is such that upon decrease in acceleration, electrical energy is stored in the device for use in the missile or projectile whenever desired.

Another approach to the safety and arming problem in ordnance fuzing is provided in U.S. Pat. No. 3,175,496 to Jean Rochat. In Rochat's invention the firing electric device comprises an electric generator, a part of the magnetic circuit of which is displacable under spring influence to produce the electric energy necessary to fire the projectile. This part of the magnetic circuit is maintained in position before discharge by a locking device sensitive to the acceleration of the projectile. It comprises an inertial mass displacable against the action of a spring.

It is accordingly an object of this invention to provide a new safety device which utilizes gas which escapes past a fuze as it emerges from its gun barrel.

It is therefore specifically an object of this invention to utilize the electrical charge exhibited by the plasma-like properties of the gas which accumulates above the fuze as it is fired as a new environmental signature.

Further objects and the entire scope of the invention will become more fully apparent in the following detailed description and the appended claims.

SUMMARY OF THE INVENTION

The ionization safety device comprises in combination with an arming mechanism for a fuze, an ionization sensor for transducing the electrical charge from plasma accumulated on the surface of a projectile as it exits its launcher. A Schmitt trigger threshold detector senses charge level of the ionization sensor and supplies a threshold signal to a standard AND, OR, or NOR logic circuit. The logic circuit determines whether or not the fuze should be armed.

BRIEF DESCRIPTION OF THE DRAWINGS

The specific nature of the invention as well as other aspects, objects, uses, and advantages thereof will clearly appear from the following description and from the accompanying drawings in which.

DESCRIPTION OF THE PREFERRED EMBODIMENT

Existing mechanical safety and arming devices have been limited in the environmental signatures used as sources of information. This invention uses gas that escapes past a shell as it emerges from the gun barrel as an additional source of information. This gas is hot enough to produce a burst of light known as "muzzle flash" and, therefore, is electrically active and exhibits properties of plasma. Electrical charge from this plasma accumulates on the surface of the projectile as it exits its launcher. This invention takes advantage of this particular phenomenon by utilizing a capacitor to accumulate and store a portion of the charge produced by the ionization. In particular, referring to FIG. 1, there is shown a functional circuit diagram with a plate capacitor 20. One metal plate of capacitor 20 is a storage plate mounted on the fuze for accumulating the charge from the ionization as the fuze exits the muzzle of the gun barrel.

Figure 4:
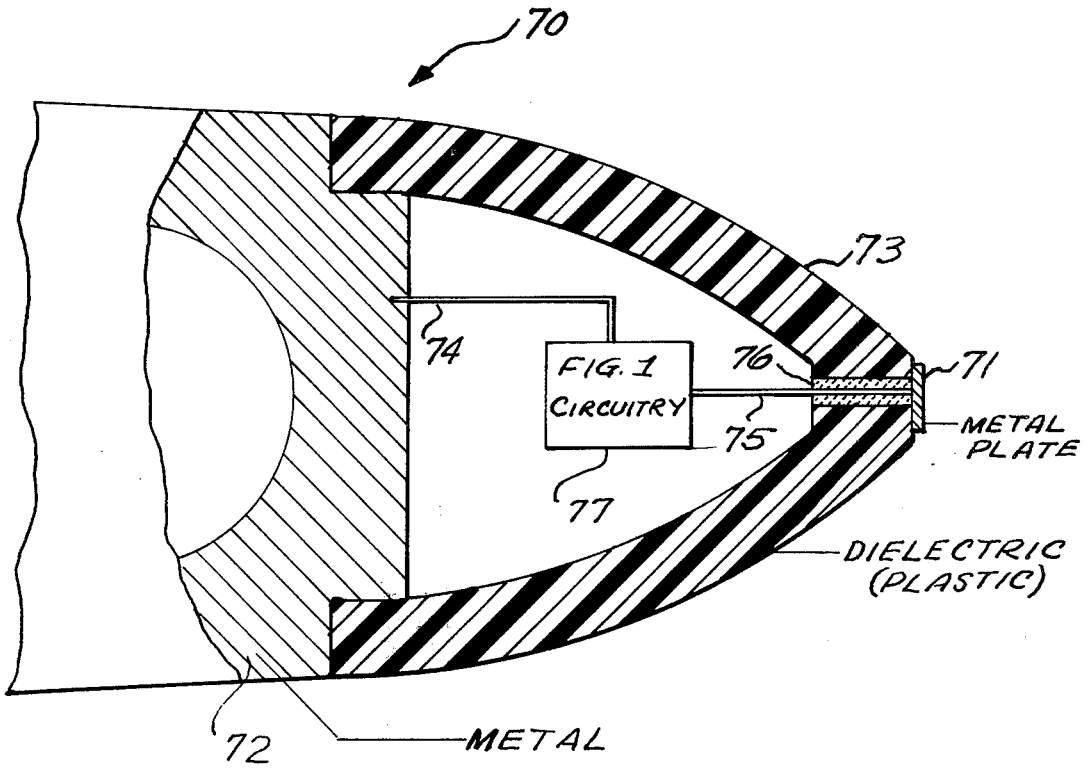
FIG. 4 is an enlarged partial cross-section and partial schematic diagram illustrating the manner in which the charge is accumulated from the surface of the projectile.

Turning now to FIG. 4, there is shown the physical arrangement of capacitor 20 mounted in a conventional projectile 70 comprising an insulating portion 73 forming the front part of the fuze. As is well known, the insulating portion 73 may be conventionally formed of a plastic material and in accordance with the present invention serves as the dielectric for capacitor 20. Mounted on the front portion of the projectile by suitable mounting means is metal plate 71 which serves as one plate of the capacitor 20. The other plate of capacitor 20 comprises the metal body 72 of the projectile.

Projecting through the nose portion of the projectile 71 and electrically connected to metal plate 71 is electrical lead 75, firmly held in place by suitable potting compound 76. Electrical lead 74 extends from metal projectile body 72 to the FIG. 1 circuitry 77. Similarly, the other end of electrical lead 75 extends to the FIG. 1 circuitry 77. The manner in which capacitor 20 is interconnected with the other components comprising the detector and circuit assembly is more fully explained hereinbelow.

Figure 1:
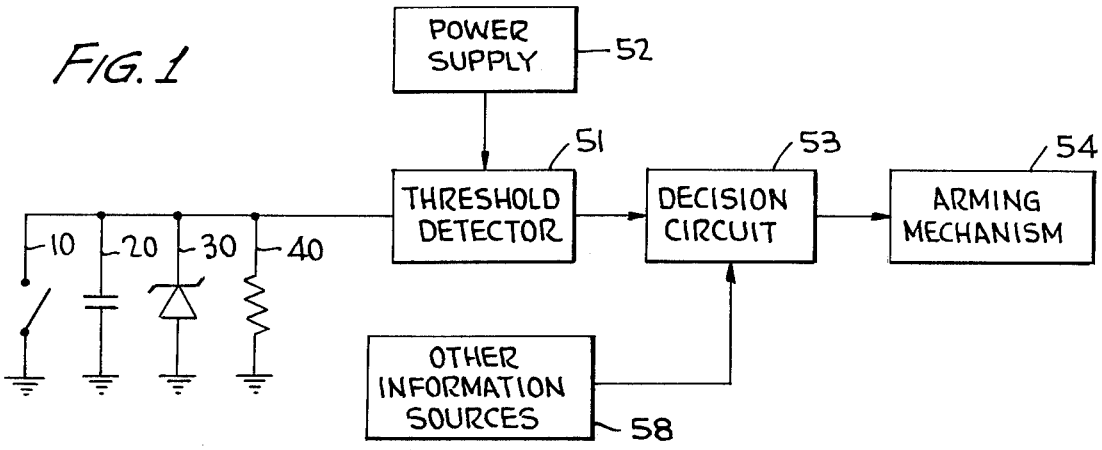
FIG. 1 is a block diagram of a general embodiment of the circuit and detector combination.

The detector and circuit assembly are shown in block diagram form in FIG. 1. The threshold detector 51 checks the voltage of the capacitor 20 to see if it is greater than a preset threshold value stored in the detector. The decision circuit 53 then combines the results of the threshold detection occurring in threshold detector 51 with information from other sources 58 generated by other environment signatures commonly used in this art and determines whether or not to initiate a signal to the arming mechanism 54. Diode 30 protects the circuitry of the threshold detector and any other components which follow from static charges. The resistor 40 is utilized to bleed off any charges that might otherwise accumulate within the circuitry. The switch 10 is inertially activated and commonly used in the art and may be of the type disclosed in U.S. Pat. No. 3,175,496 to Jean Rochat. The normally closed switch 10 shorts out the capacitor 20 until the time for firing of the projectile.

In those situations where the ionization charge generated by the gun propellant is not stored on the capacitor 20 a sufficient period of time for the thermal reserve battery to achieve proper power to supply the threshold detector, a decision on the charge's amplitude has to be made in a very short period of time. Accordingly, an environmental power supply such as a piezoelectric crystal or magnetic coil system such as disclosed in U.S. Pat. No. 3,324,317 issued to G. L. Hazelet or as disclosed in U.S. Pat. No. 3,356,026 issued to J. Lubig may be used for power supply 52.

The threshold detector 51 is comprised essentially of C/MOS circuitry. This circuitry is shown in detail in FIG. 2. In this circuit, Q is a normal circuit output and $\bar{Q}$ is the inverted output. The circuit is comprised of three C/MOS inverters 1, 2, and 3 connected to form a classic Schmitt trigger threshold detector (STTD) with Q and $\bar{Q}$ outputs. In particular, a resistor 5 is interposed between inverter 1 and inverter 2. A capacitor 4 is placed in parallel with the series connection of resistor 5 and inverters 2 and 3. The ionization signal is fed directly into inverter 1. The output of the STTD is taken from the interconnection between inverter 2 and inverter 3.

Figure 2:
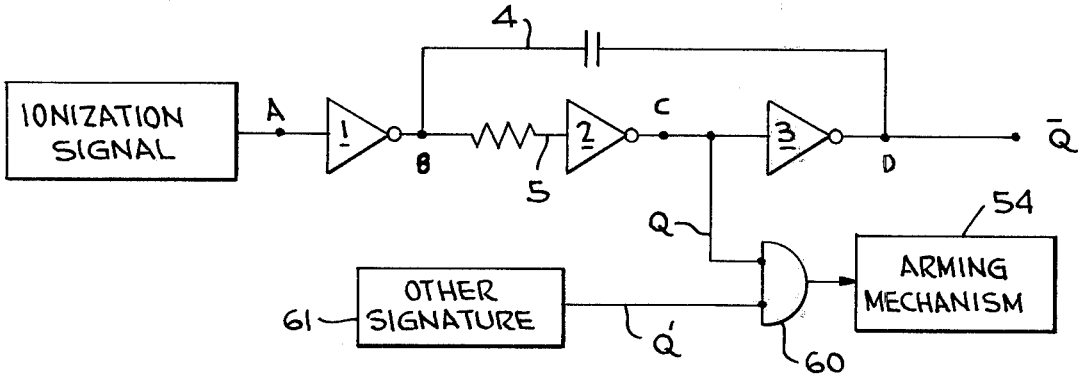
FIG. 2 is a circuit diagram of the Schmitt trigger threshold detector.
Figure 3:
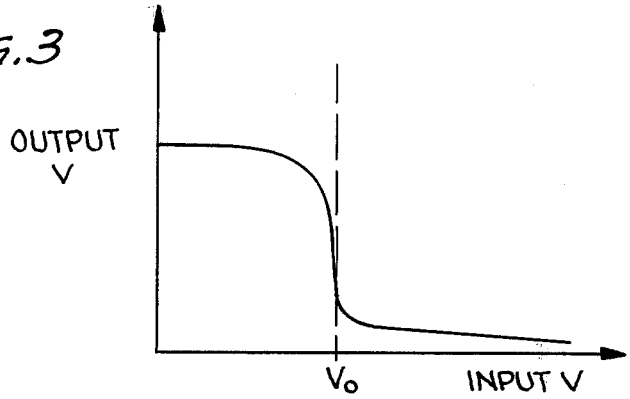
FIG. 3 is a graph of the input-output curve of a C/MOS inverter.

In FIG. 3, the input-output curve of a C/MOS inverter is shown. $V_0$ is the threshold voltage of the device. Q goes the input voltage at node A (see FIG. 2) reaches the threshold voltage of inverter 1, the voltage at node B starts downward. This voltage is inverted by inverter 2 and again by inverter 3. Thus, voltage at node C goes up while the voltage at node D goes downward. The signal at node D is fed back through capacitor 4 to node B augmenting the signal already there. This feedback continues, rapidly switching the STTD to the Q = 1 state. When the input ionization signal drops below the threshold voltage, the situation is reversed and Q goes to the 0 state. An operational embodiment of the circuit may use the value of 1 megohm for the resistor 5 and 0.0068 microfarads for the value of the capacitor 4. A large 20 megohm resistor may be used in place of the capacitor.

The decision to fire or actuate the arming mechanism is made by logic circuit 60 in the particular embodiment shown in FIG. 2. If another signature 61 is programmed to also give a positive Q state then logic circuitry 60 is selected to be either an AND, OR, or NOR gate as appropriate to the situation programmed. Specifically, if it is desired that the fuze be armed when a 1 state appears either at Q or Q′ then logic circuit 60 must be an OR gate. If both Q and Q′ must be in the 1 state, then an AND logic gate is appropriate. However, if both Q and Q′ must be in the 0 state then a NOR logic gate is appropriate.

The inventor wishes it to be understood that he does not desire to be limited to the exact details shown herein for obvious modifications will occur to a person skilled in this art.

What is claimed is:

1. In combination with an electrically actuated arming mechanism for a fuze, an electrical safety device comprising:

a. an ionization sensor;

b. a threshold detector connected to said sensor; and c. a decision circuit connected to said detector.

2. The invention of claim 1 wherein the decision circuit comprises logic gating means.

3. The invention of claim 2 wherein the threshold detector comprises a Schmitt trigger, said trigger having a normal output and an inverted output.

4. The invention of claim 3 wherein the ionization sensor is comprised of a portion of conductive material which comprises an outer shell for said fuze.

5. The invention of claim 4 further comprising an environmentally activated power supply connected to said threshold detector.

6. The invention of claim 4 further comprising at least one rectifying means connected in forward bias between an input to the threshold detector and ground.

7. The invention of claim 6 further comprising at least one resistive means connected between an input to the threshold detector and ground.

8. The invention of claim 7 further comprising a normally closed inertial switch connected to said ionization sensor.

9. The invention of claim 8 wherein a portion of said ionization sensor is a capacitor.

10. The invention of claim 9 wherein one plate of said capacitor comprises a portion of said conductive material.

* * * * *